US006049687A

United States Patent [19]

Hibino et al.

[11] Patent Number: 6,049,687

[45] Date of Patent: Apr. 11, 2000

[54] DEVELOPING APPARATUS

[75] Inventors: Masaru Hibino, Minami Ashigara; Yoshiaki Kobayashi, Numazu; Masanori Shida, Shizuoka-ken; Ichiro Ozawa, Susono, all of Japan

[73] Assignee: Canon Kabushiki Kaisha, Tokyo, Japan

[21] Appl. No.: 09/179,880

[22] Filed: Oct. 28, 1998

[30] Foreign Application Priority Data

Oct. 31, 1997 [JP] Japan ..... 9-316477

[51] Int. Cl.[7] ..... G03G 15/09; G03G 9/08

[52] U.S. Cl. ..... 399/270; 430/122

[58] Field of Search ..... 399/235, 265, 399/267, 270, 266; 430/120, 121, 122, 106.6

[56] References Cited

U.S. PATENT DOCUMENTS

| | | | |
|---|---|---|---|
| 4,590,140 | 5/1986 | Mitshuhashi et al. | 430/102 |
| 4,941,019 | 7/1990 | Honda et al. . | |
| 5,030,996 | 7/1991 | Tajima et al. . | |
| 5,438,394 | 8/1995 | Suzuki et al. . | |
| 5,494,770 | 2/1996 | Baba et al. | 430/122 |
| 5,534,982 | 7/1996 | Sakaizawa et al. | 399/267 |
| 5,576,812 | 11/1996 | Hibino et al. . | |

FOREIGN PATENT DOCUMENTS 6-19222 1/1994 Japan .

*Primary Examiner*—Matthew S. Smith
*Assistant Examiner*—Hoang Ngo
*Attorney, Agent, or Firm*—Fitzpatrick, Cella, Harper & Scinto

[57] ABSTRACT

A developing apparatus has a developer bearing member disposed in opposed relationship with an image bearing member bearing an electrostatic image thereon with a gap of $6\times10^{-4}$ m or less with respect to the image bearing member, and bearing and conveying a developer thereon. The developer bearing member is moved in a direction opposite to the direction of movement of the image bearing member in the portion opposed to the image bearing member, and the developer has a non-magnetic toner and a carrier of which the magnetization rate in a magnetic field of 1000 gauss is equal to or greater than 30 emu/cm$^3$ and equal to or less than 200 emu/cm$^3$ and the specific resistance at electric field intensity of $5\times10^4$ V/m is $10^{12}$ Ωcm or greater. The developing apparatus further has applying means for applying a bias voltage having a vibration component to the developer bearing member. The bias voltage applied to the developer bearing member and the gap between the image bearing member and the developer carrying member satisfy the following relation:

$$2.0\times10^6 \leq V/d < 4.0\times10^6,$$

where

V: the amplitude (V) of the vibration component of the bias voltage;

d: the size (m) of the gap between the image bearing member and the developer bearing member.

5 Claims, 4 Drawing Sheets

DEVELOPING APPARATUS

BACKGROUND OF THE INVENTION

1. Field of the Invention

This invention relates to a developing apparatus used in an image forming apparatus such as a copying apparatus or a printer using the electrophotographic system or the electrostatic recording system to develop an electrostatic image on an image bearing member.

2. Related Background Art

Various apparatuses have heretofore been proposed and put into practical use as electrophotographic developing apparatuses. These developing apparatuses are divided roughly into developing apparatuses using a one-component developing system and developing apparatuses using a two-component developing system. In the one-component developing system, almost all of the apparatuses adopt a noncontact system, and as a typical developing method, there is a one-component jumping developing method using a magnetic toner. This developing method can provide images of high quality by an easy construction, but suffers from the disadvantage that color images cannot be provided because a magnetic material is contained in the toner. Also, a one-component developing method using a nonmagnetic toner can provide color images, but it is difficult to apply the toner onto a developing sleeve and at present, coating is effected by an elastic blade, and this method lacks stability and durability.

On the other hand, the two-component developing method conveys a toner to a developing area by a magnetic carrier and effects development, and usually effects the developing step with the developer brought into contact with a photosensitive drum. Here, the developing step will be described with reference to FIG. 4 of the accompanying drawings. As shown in FIG. 4, the developing apparatus 40 of this example is provided with a developing container 34, a developing sleeve 30 which is a developer carrying (bearing) member opposed to an electrophotographic photosensitive member 50 which is an image bearing member and disposed in the opening portion of the developing container 34, a magnet roller 35 which is magnetic field producing means fixedly disposed in the developing sleeve 30, a regulating blade 33 which is a developer layer thickness regulating member for regulating the layer thickness of a developer carried on the developing sleeve 30, and agitating screws 31 and 32 contained in the developing container 34.

A description will hereinafter be made of the developing step of visualizing an electrostatic latent image formed on the electrophotographic photosensitive member 50 by a two-component magnetic brush method by the use of the above-described developing device 40, and a circulating system for the developer.

First, the developer drawn up by a pole N3 with the rotation of the developing sleeve 30 is regulated by the regulating blade 33 in the process of being conveyed from pole S2 to pole N1, and is formed into a thin layer on the developing sleeve 30. When the developer formed into a thin layer is conveyed to a main developing pole S1, the erection of the developer is formed by a magnetic force. The above-mentioned electrostatic latent image is developed by the developer formed into an ear-like shape, whereafter the developer on the developing sleeve 30 is returned into the developing container 34 by the repulsive magnetic fields of a pole N3 and a pole N2.

A DC bias and an AC bias are applied from a voltage source, not shown, to the developing sleeve 30. Generally, in the two-component developing method, when an AC bias is applied, the developing efficiency increases and the resultant image becomes high in quality, but there arises the danger that fogging is liable to occur.

As a latent image forming method, there is known a method of scanning and exposing an electrophotographic photosensitive member by a laser beam modulated correspondingly to a recorded image signal, and forming an electrostatic latent image comprising latent images of a dot-distributed shape, i.e., a dot-like shape, distributed correspondingly to the image. Above all, the so-called pulse width modulation (PWM) method of modulating the width (i.e., duration time length) of the driving pulse current of a laser correspondingly to the light and shade of a recorded image can provide high recording density (i.e., high resolution) and high gradation property.

In the image forming method using the two-component developing system as described above, to provide a still higher quality of image and a longer life, a developing method using a carrier of low magnetic permeability, or in other words, a carrier having a low magnetization value in a magnetic field of 1000 gauss, is proposed, for example, in Japanese Laid-Open Patent Application No. 6-19222.

By using a carrier of low magnetic permeability, the carrier (developer) is weakly restrained on the developing sleeve, whereby the frictional sliding force of a magnetic brush with respect to a toner image developed for the electrostatic latent image on the photosensitive drum in a developing portion is weakened, whereby a higher quality of image becomes possible. Also, the packing pressure of a developer reservoir upstream of the developer layer thickness regulating blade with respect to the direction of rotation of the developing sleeve drops and the deterioration of the toner is reduced, whereby a longer life becomes possible.

In that case, assuming that the value of magnetization in a magnetic field of 1000 gauss is used as the standard of the magnetization or magnetic permeability of the carrier, when use is made of a low magnetic permeability carrier having magnetization of 200 emu/cm$^3$ or less in the magnetic field of 1000 gauss, particularly the deterioration of the toner described above is reduced. Also, at this time, it is minimally necessary from the viewpoint of stable coating on the developing sleeve to have magnetization of 30 emu/cm$^3$ or greater.

On the other hand, the use of the low magnetic permeability carrier leads to the problems of carrier adherence and low image density in a high density portion. Carrier adherence occurs due to the fact that the magnetization of the carrier is small, whereby in a nonimage portion, an electrostatic force by fog-removing bias Vback is superior to a magnetic force. This is due to the fact that the fog-removing bias Vback is an electric field in a direction to pull, the fog toner back to the developing sleeve from the photosensitive drum and the carrier opposite in polarity to the toner becomes an electric field conversely attracting the toner toward the photosensitive drum.

As the causes of the carrier adherence, there are conceivable, besides the case as described above where the electrostatic force has become stronger than the magnetic force, a case where charges have been poured into the carrier, and a case where the carrier adheres to the photosensitive drum by the mirror image force by the poured charges. The pouring of charges into the carrier is due chiefly to the AC component of the developing bias.

On the other hand, low image density occurs particularly in a high density portion because the magnetization of the carrier is small, whereby the length of the magnetic brush becomes short and in a developing area, the length of the developer contacting with the photosensitive drum in the circumferential direction of the photosensitive drum becomes short and the developer assumes its noncontact state particularly when the amount of coat of the developer on the developing sleeve is small and the gap between the developing sleeve and the photosensitive drum (hereinafter referred to as the S-Dgap) is wide. Also, at this time, the so-called edge emphasis that the edge portion of the high density portion is emphasized becomes liable to occur.

Of the aforedescribed problems arising from the use of the low magnetic permeability carrier for a high quality of image and a long life, the adherence of the carrier can be greatly reduced by making the resistance of the carrier great (for example, Japanese Patent Application Laid-Open Nos. 8-227225 and 8-160671). In that case, as the specific resistance of the carrier, the use of a magnetic carrier having $10^{12}$ Ωcm or greater at electric field intensity of $5\times10^4$ V/m is effective. However, making the resistance of the carrier greater reduces the opposed electrode effect to the charges on the photosensitive drum and therefore, the above-mentioned edge emphasis is promoted.

Also, of the aforedescribed problems, regarding the low image density in the high density portion and the edge emphasis, a great effect is obtained by making the direction of movement of the photosensitive drum and the direction of movement of the two-component developer opposite to each other in the developing area (counter phenomenon). However, when the amount of coating of the developer on the developing sleeve is small and the S-Dgap is wide, the developer becomes more approximate to the noncontact state and the low image density in the high density portion and the edge emphasis become somewhat liable to occur.

SUMMARY OF THE INVENTION

It is an object of the present invention to provide a developing apparatus in which the image density of a high density portion is prevented from dropping.

It is another object of the present invention to provide a developing apparatus in which edge emphasis can be suppressed.

It is still another object of the present invention to provide a developing apparatus having:

a developer carrying (bearing) member disposed in opposed relationship with an image bearing member bearing an electrostatic image thereon with a gap of $6\times10^{-4}$ m or less therebetween for carrying and conveying a developer thereon, and the developer carrying member being moved in its opposed portion in the direction opposite to the direction of movement of the image bearing member, and the developer having a magnetic toner and a carrier of which the magnetization rate in a magnetic field of 1000 gauss is equal to or greater than 30 emu/cm$^3$ and equal to or less than 200 emu/cm$^3$ and the specific resistance at electric field intensity of $5\times10^4$ V/m is $10^{12}$ Ωcm or greater; and applying means for applying a bias voltage having a vibration component to the developer carrying member; and the bias voltage and the gap satisfy the following relation:

$$2.0\times10^6 \leq V/d < 4.0\times10^6,$$

where

V: the amplitude (V) of the vibration component d: the gap (m) between the image bearing member and the developer carrying member.

Further objects of the present invention will become apparent from the following description.

DESCRIPTION OF THE PREFERRED EMBODIMENTS

An image forming apparatus according to the present invention will hereinafter be described in detail with reference to the drawings.

Embodiment 1

Figure 1:
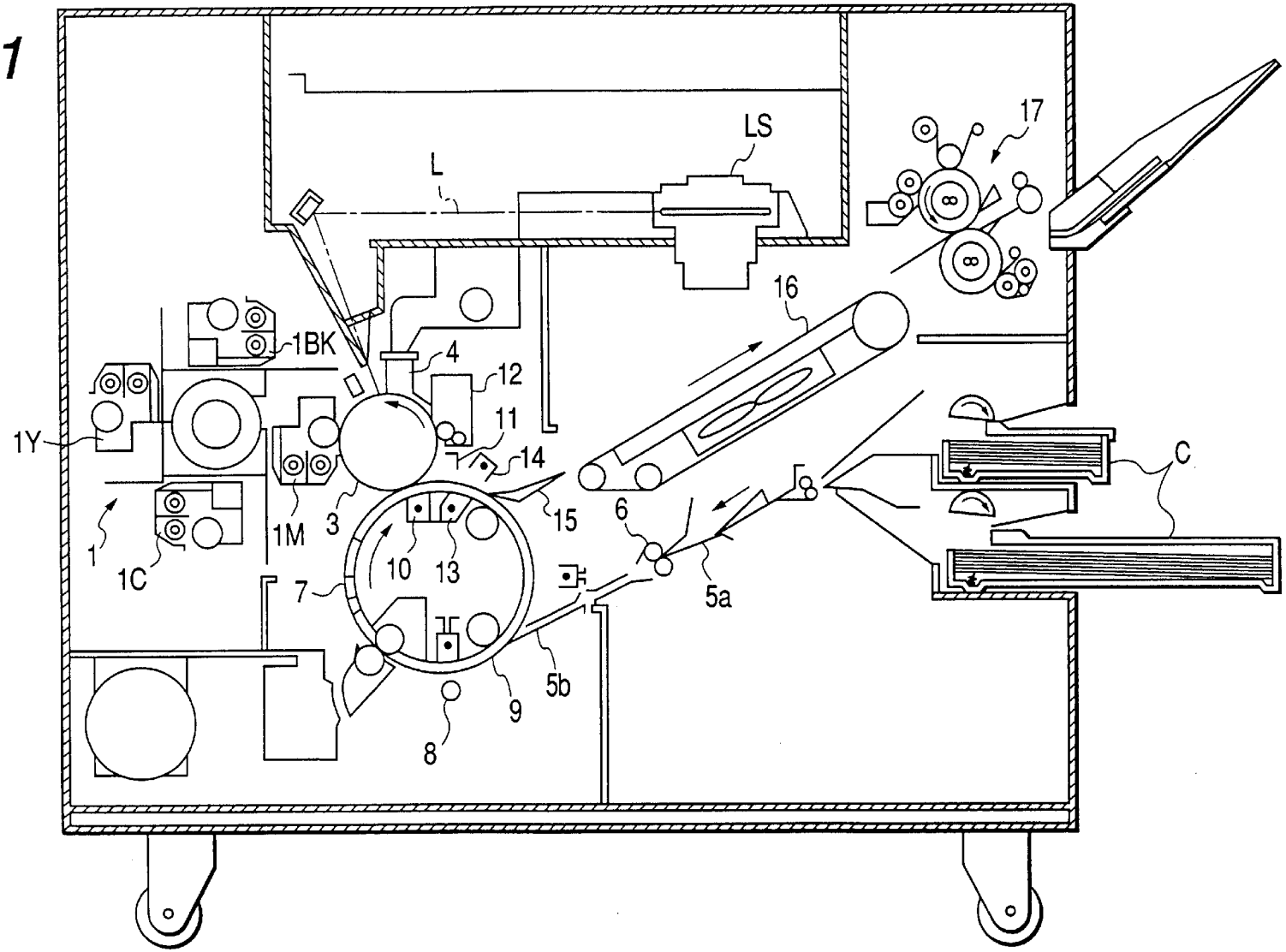
FIG. 1 shows the general construction of an embodiment of a full color image forming apparatus according to the present invention.

FIG. 1 shows a color image forming apparatus which is a color printer of the electrophotographic type to which the present invention can be applied.

This printer is provided with an electrophotographic photosensitive drum 3 which is an image bearing member rotatable in the direction of the curved arrow, and around the photosensitive drum 3, there are disposed a primary charger 4, a rotatable developing apparatus 1 provided with developing devices 1M, 1C, 1Y and 1BK, a transfer charger 10, cleaning means 12 and image forming means comprising a laser beam scanner LS or the like disposed above the photosensitive drum 3. Each of the developing devices 1M, 1C, 1Y and 1BK supplies the photosensitive drum 3 with a two-component developer containing toner particles and carrier particles. The developer in the developing device 1M contains a magenta toner, the developer in the developing device 1C contains a cyan toner, the developer in the developing device 1Y contains a yellow toner, and the developer in the developing device 1BK contains a black toner.

An original to be copied is read by an original reading device, not shown. This original reading device has a photoelectric conversion element such as a CCD for converting the image of the original into an electrical signal, and outputs image signals corresponding to the magenta image information, the cyan image information, the yellow image information and the black-and-white image information of the original. A semiconductor laser contained in the scanner LS is controlled correspondingly to these image signals, and emits a laser beam L. An output signal from an electrophotographic computer can also be printed out.

Briefly describing the sequence of the entire color printer with the case of a full color mode as an example, the photosensitive drum 3 is first uniformly charged by the primary charger 4. Next, scanning and exposure are effected by the laser beam L modulated by the magenta image signal, whereby a dot distribution electrostatic latent image is formed on the photosensitive drum 3, and this latent image is effected in reversal developing by the magenta developing device 1M placed at a developing position in advance.

A transfer material such as paper taken out of a cassette C and advanced via a paper feeding guide 5*a*, paper feeding rollers 6 and a paper feeding guide 5*b* is held by the gripper 7 of a transfer drum 9, and is electrostatically wound around the transfer drum 9 by a roller 8 for bearing and a pole opposed thereto. The transfer drum 9 is rotated in the direction of arrow in synchronism with the photosensitive drum 3, and a magenta visualized image developed by the magenta developing device 1M is transferred to the transfer material by a transfer charger 10 in a transfer station. The transfer drum 9 continues to be rotated and is prepared for the transfer of an image of the next color (in FIG. 1, cyan).

On the other hand, the photosensitive drum 3 has its charges removed by a charger 11, is cleaned by cleaning means 12, is again charged by the primary charger 4, and is subjected to exposure as described above by the laser beam L modulated by the next cyan image signal, whereby an electrostatic latent image is formed on the photosensitive drum. In the meantime, the developing apparatus 1 makes one full rotation, and the cyan developing device 1C is placed at a predetermined developing position and effects the revering and development of a dot distribution electrostatic latent image corresponding to cyan, thereby forming a cyan visualized image.

Subsequently, the steps as described above are effected for each of the yellow image signal and the black image signal. When the transfer of the visualized images of four colors (toner images) is completed, the transfer material has its charges removed by charges 13 and 14, is released from the gripper 7, is separated from the transfer drum 9 by a separating pawl 15 and is sent to a fixating device (heat-pressure roller fixating device) 17 by a conveying belt 16. The fixating device 17 fixates the visualized images of four colors lying one upon another on the transfer material.

Thus, a series of full color printing sequences are terminated and a required full color print image is formed.

The present construction is an example and for example, the primary charger 4 may be not a corona charger but a charging roller, and the transfer charger 7 may also be a transfer roller and thus, there are various types of charges, but basically, as described above, an image is formed by the steps of charging, exposure, transfer and fixation.

As an example, the developing device 1M will now be described with reference to FIG. 2.

Figure 2:
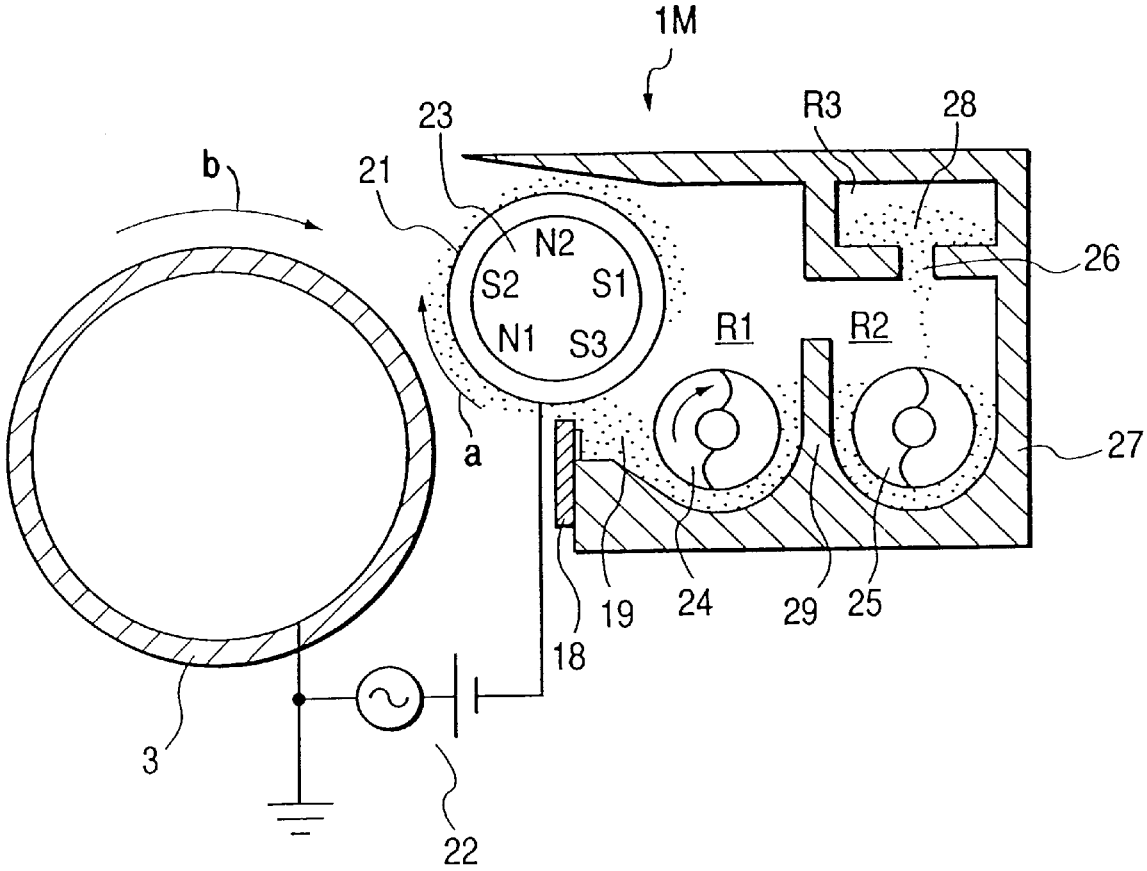
FIG. 2 is a schematic side view showing an embodiment of a developing device according to the present invention.

The developing device 1M is provided with a developing container 27, as shown in FIG. 2. The interior of the developing container 27 is compartmented into a developing chamber (first chamber) R1 and an agitating chamber (second chamber) R2 by a partition wall 29, and a toner storing chamber R3 is formed above the agitating chamber R2 with the partition wall 29 therebetween, and a supply toner (nonmagnetic toner) 28 is contained in the toner storing chamber R3. The partition wall 29 is provided with a supply port 26, via which the supply toner 28 corresponding in amount to the consumed toner falls and is supplied into the agitating chamber R2.

In contrast, a developer 19 is contained in the developing chamber R1 and the agitating chamber R2. The developer 19 is a two-component developer comprising a toner of an average particle diameter of 8 $\mu$m manufactured by a crushing method and having extraneously added thereto 1% weight ratio of titanium oxide of an average particle diameter of 20 nm, and magnetic particles (carrier) of an average particle diameter of 50 $\mu$m of which the value of magnetization at 1000 gauss is 130 emu/cm$^3$. The mixing ratio was such that the nonmagnetic toner was about 5% by weight.

An opening portion is provided in that region of the developing container 27 which is proximate to the photosensitive drum 3, and a developing sleeve 21 half-protrudes outwardly from the opening portion. Also, the developing sleeve 21 is rotatably incorporated in the developing container 27. The developing sleeve 21 is formed of a nonmagnetic material, and a magnet 23 which is magnetic field producing means is fixed to the interior thereof.

The magnet 23 has a developing magnetic pole N1, a magnetic pole S3 located upstream thereof with respect to the direction of rotation of the developing sleeve 21, and magnetic poles N2, S2 and S1 for conveying the developer 19. The magnet 23 is disposed in the developing sleeve 21 so that the developing magnetic pole N1 may be opposed to the photosensitive drum 3. The developing magnetic pole N1 forms a magnetic field near the developing portion between the developing sleeve and the photosensitive drum 3, and a magnetic brush is formed by the magnetic field. At this position, the developer 19 carried in the direction of arrow with the rotation of the developing sleeve 21 contacts with the photosensitive drum 3 which rotates in the direction of arrow b, and the electrostatic latent image on the photosensitive drum 3 is developed. At this time, at the proximate position (developing portion) between the developing sleeve 21 and the photosensitive drum 3, the developing sleeve 21 and the photosensitive drum 3 are moved in opposite directions (counter directions).

A vibration bias voltage comprising a DC voltage superposed on an AC voltage is applied from a voltage source 22 to the developing sleeve 21. The dark portion potential (nonexposed portion potential) and light portion potential (exposed portion potential) of the latent image are located between the maximum value and minimum value of the above-mentioned vibration bias potential. Thereby, an alternating electric field of which the directions change alternately is formed in the developing portion. In this alternating electric field, the toner and the carrier vibrate vehemently and the toner shakes off the electrostatic restraint to the developing sleeve 21 and the carrier, and an amount of toner corresponding to the potential of the latent image adheres to the photosensitive drum 3. The difference between the maximum value and minimum value (peak-to-peak voltage), frequency and waveform of the vibration bias voltage suitably used in the present embodiment will be described later in detail.

Now, below the developing sleeve 21, a regulating blade 18 which is a developer layer thickness regulating member fixed to the developing container 27 is disposed at a predetermined interval with respect to the developing sleeve 21. The interval between the developing sleeve 21 and the regulating blade 18 is 500 $\mu$m. The regulating blade 18 is formed of a nonmagnetic material such as aluminum or SUS 316, and regulates the layer thickness of the developer 19 on the developing sleeve 21.

A conveying screw 24 is contained in the developing chamber R1. The conveying screw 24 is rotated in the direction of arrow, and by the rotative driving of the conveying screw 24, the developer 19 in the developing chamber R1 is conveyed in the lengthwise direction of the developing sleeve 21.

A conveying screw 25 is contained in the developing chamber R2. The conveying screw 25 conveys the toner 28 having freely dropped from a supply port 26 into the agitating chamber R2 along the lengthwise direction of the developing sleeve 21 by the rotation thereof.

Figure 3:
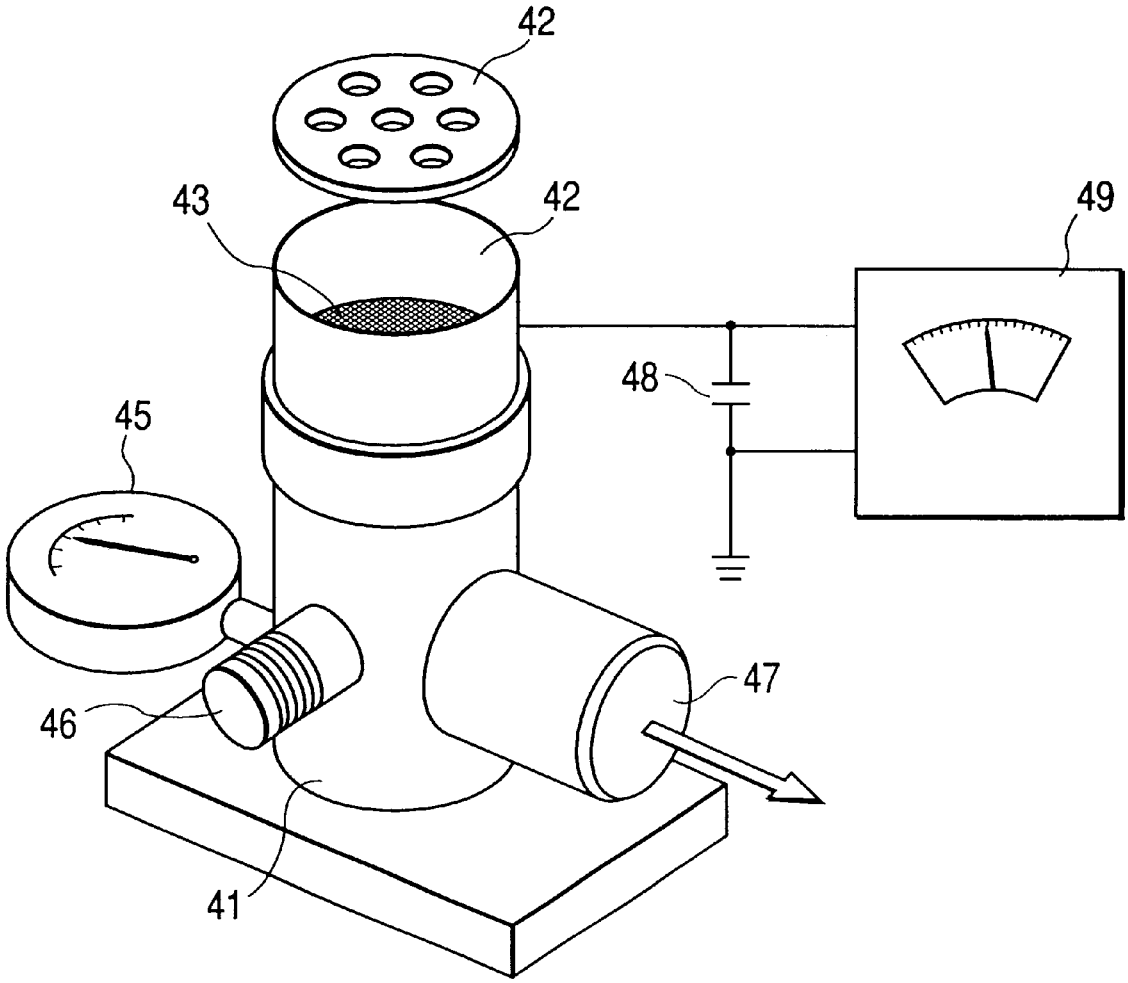
FIG. 3 is a typical view of a device for measuring the amount of frictional charging of a two-component developer.
Figure 4:
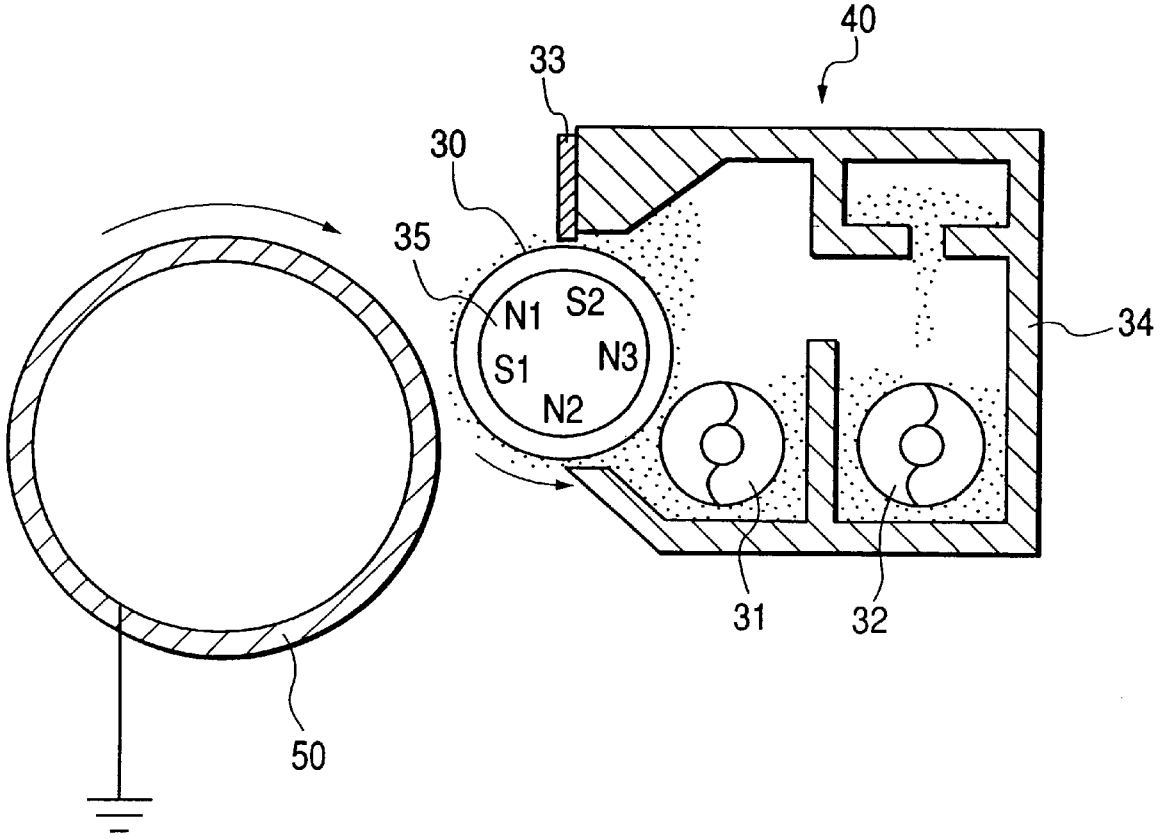
FIG. 4 is a schematic side view showing a developing device.

Here, a method of measuring the amount of frictional charging of the toner (two-component developer) will be described with reference to FIG. 3. FIG. 3 is an illustration of an apparatus for measuring the amount of tribo charge of the toner.

First, the two-component developer of which the amount of frictional charging is to be measured is put into a bottle of capacity of 50 to 100 ml made of polyethylene, and is shaked by a hand for about 10 to 40 sec., and the developer is put into a metallic measuring container 42 having a screen 43 of about 0.5 to 1.5 g and 500 meshes, and a metallic lid 44 is put on the container. The weight of the entire measuring container 42 at this time is measured as W1 (kg).

Next, in a suction device 41 of which at least the portion contacting with the measuring container 42 is made of an insulative material, suction is effected from a suction port 47 and a gas volume adjusting valve 46 is adjusted to render the pressure of a vacuum gage 45 into 250 mmAq. In this state, suction is effected for ten minutes, preferably two minutes to suck and remove resin. The potential of a potentiometer 49 at this time is V (volt). A capacitor 48 is connected to the potentiometer 49, and the capacity thereof is C (F). Also, the weight of the whole of the measuring container 42 after the suction is measured, and the weight is W2 (kg). At this time, the amount of frictional charging of the toner is calculated as follows:

The amount of frictional charging of resin $$(c/kg)=(C\times V\times 10^{-3})/(W1-W2)$$

In the present embodiment, use was made of resin of which the amount of frictional charging was about $2.0\times10^{-2}$ c/kg.

The volume average particle diameter of the toner may preferably be 4 to 15 $\mu$m. Here, the volume average particle diameter of the toner used is, for example, that measured by the following measuring method.

Coaltar counter TA-II type (produced by Coaltar Inc.) is used as a measuring apparatus, and an interface (produced by Nikkaki) outputting a number average distribution and CX-i personal computer (produced by Canon) are connected thereto, and first-class sodium chloride is used as electrolyte and 1% NaCl water solution is adjusted.

As a measuring method, 0.1 to 5 ml of interfacial active agent (preferably alkyl benzene sulfonate) is added as a dispersant to the above-mentioned electrolytic water solution of 100 to 150 ml, and 0.5 to 50 mg of measuring sample is further added.

The electrolyte in which the sample is suspended is subjected to a dispersing process by an ultrasonic dispersing device for about 1 to 3 minutes, and with 100 $\mu$m aperture used as an aperture, the particle size distribution of particles of 2 to 40 $\mu$m is measured by the above-mentioned Coaltar counter TA-II type to thereby find the volume distribution. By the thus found volume distribution, the volume average particle diameter of the sample is obtained.

By further covering the surface of the toner as described above with an extraneous additive, there are two effects in terms of hardware. One of them is that fluidity is improved and the supplied toner becomes easy to mix with the two-component developer in the developing container and agitate, and the other is that by the extraneous additive intervening on the surface of the toner, the parting property of the toner developed on the photosensitive drum with respect to the photosensitive drum is increased and transfer efficiency becomes good.

The extraneous additive used in the present invention may preferably have a particle diameter of 1/10 or less of the weight average diameter of the toner particles, from the viewpoint of the durability when it is added to the toner. The particle diameter of this additive means the average particle diameter of the toner particle found by the observation of the surface thereof in an electronic microscope. As the extraneous additive, for example, the following may be used:

A metal oxide (such as aluminum oxide, titanium oxide, titanic acid strontium, cerium oxide, magnesium oxide, chromium oxide, tin oxide or zinc oxide), a nitride (silicon nitride or the like), a carbide (silicon carbide or the like), metal salt (such as calcium sulfate, barium sulfate or calcium carbonate), fatty acid metal salt such as (zinc stearate or calcium stearate), carbon black silica or the like.

As the extraneous additive, 0.1 to 10 parts by weight, and preferably 0.05 to 5 parts by weight is used relative to 100 parts by weight of toner particles. One or more of these extraneous additives may be used. Preferably, the extraneous additives may be subjected to hydrophobic treatment. In the present embodiment, use is made of an additive to which 1% by weight of titanium oxide having an average particle diameter of 20 nm is extraneously added.

As the carrier constituting the developer used in the present invention with the toner as described above, a conventional one can be used. For example, use can be made of a resin carrier comprising magnetite as a magnetic material dispersed in resin, and carbon black dispersed for electrical conductivity and resistance adjustment, or a carrier in which resistance adjustment was effected with the surface of magnetite such as ferrite oxidized and reduced, or a carrier in which resistance adjustment was effected with the surface of magnetite such as ferrite coated with resin. The method of manufacturing these magnetic carriers is not especially limited.

In the present embodiment, as the magnetic carrier, use is made of a carrier of which the weight average particle diameter is 20 to 100 $\mu$m, and preferably 20 to 70 $\mu$m, and the specific resistance is $10^{12}$ Ωcm or greater at electric field intensity of $5\times 10^4$ V/m. As a method of measuring the specific resistance of the carrier used in this case, use was made of a method of filling a cell with the carrier, disposing an electrode 1 and an electrode 2 so as to be in contact with this filling carrier, applying a voltage to between these electrodes, and measuring an electric current flowing at that time to thereby find the specific resistance. In the above-described measuring method, care must be taken because the carrier is powder and therefore a change occurs to the filling rate and along therewith, the specific resistance may change. Also, the conditions for measuring the specific resistance of the carrier used in the present invention are as follows: the contact area S between the filling carrier and the electrodes= about 2.3 $cm^2$, the thickness d=about 2 mm, the load of the upper electrode 2=180 g, and the applied voltage=100 V.

A description will now be made in detail of the relation between the difference between the maximum value and minimum value of the vibration bias (peak-to-peak voltage: Vpp) used in the present embodiment, and S-Dgap, including the action thereof.

When image formation is done by the counter developing system by the use of the two-component developer as hitherto described containing a nonmagnetic toner and a magnetic carrier having magnetization of 30 to 200 (emu/$cm^3$) [equal to or greater than 30 and equal to or less than 200] in a magnetic field of 1000 gauss and of which the specific resistance is $10^{12}$ Ωcm or greater at the electric field intensity of $5\times10^4$ V/m, the following problems arise.

Firstly, when the value of Vpp to the S-Dgap, i.e., the maximum electric field in the developing area (here the potential difference between Vcont and Vback is neglected), is great, leakage occurs.

Secondly, when the value of Vpp to the S-Dgap is small, low image density in the high density portion and edge emphasis resulting from the low image density occur. The edge emphasis resulting from the low image density in the high density portion is that the electric field of the high density portion (black solid portion) or in other words, the difference between the potential of a location on the photosensitive drum corresponding to the high density portion and the potential of the developing sleeve, remains edge-emphasized because due to the movement of the toner charges, i.e., a state not converged by development, image density is not put out and there is a potential difference between the high density portion potential and the low density portion potential (the high light and halftone portions).

Thirdly, the more separate from the photosensitive drum becomes the developing sleeve, the edge emphasis is more liable to occur. This is due to the fact that in the present construction using a carrier of high resistance, no electrically conductive substance is present near the charging charges on the photosensitive drum and thus, the more separate becomes the electrically conductive developing sleeve which may become an opposed electrode, the more edge-emphasis results.

So, actually, the value of Vpp was allotted to the S-Dgap and evaluation paying attention to the low image density of the high density portion, edge emphasis and leak was done.

In the present study, the diameter of the developing sleeve was 16 mm, the diameter of the photosensitive drum was 30 mm, and the values of Vpp were allotted as 1000, 2000, 3000 and 4000 V to the nearest distances [S-Dgap] 300, 400, 500, 600 and 700 $\mu$m, respectively, between the developing sleeve and the photosensitive drum.

Also, the amounts of coating of the developer on the developing sleeve were fixed to 18.8 mg/cm$^2$, 31.1 mg/cm$^2$ and 37.5 mg/cm$^2$ when the S-Dgaps were 300 $\mu$m, 500 $\mu$m and 600 $\mu$m, respectively, with 25.0 mg/cm$^2$ per unit area (mm$^2$) (the true density of the carrier: 5.1 g/cm$^3$, the true density of the toner: 1.1 g/cm$^3$) when the S-Dgap is 400 $\mu$m as the standard, and evaluation was done.

Further, the amount of frictional charging of the toner was $2.0\times10^{-2}$ C/kg, and Vcont. (developing contrast voltage, the differential voltage between the potential during 256/256 harmony (black solid portion) and the potential of the developing sleeve) was fixed to 170 V, and Vback (fog removing bias) was fixed to 150 V, and a rectangular AC bias of 2 kHz as a developing bias was superposed thereupon. When the value of Vback is too small, the fog of the white ground portion cannot be removed, and when the value of Vback is too great, the adherence of the carrier occurs. So, in the present study, the proper value of Vback was fixed to 150 V.

The peripheral velocities of the photosensitive drum and the developing sleeve were fixed to 150 mm/s and 225 mm/s (peripheral velocity ratio 1.5 times) in the direction opposite to the direction of movement of the photosensitive drum in the mutually opposed portion of the photosensitive drum and the developing sleeve, respectively. The result of the present study is shown in Table 1 below.

In Table 1, from the valued of the S-Dgap (m) and the amplitude (V) of Vpp, namely, V(V), the maximum electric field in the developing area (the potential difference between Vcont and Vback being neglected) by the developing bias is represented as V/d ($\times10^6$ V/m). Also, the low image density of the high density portion is referred to and represented as Dmax (unit: O. D.). Regarding the edge emphasis levels, the following were adopted.

A: the level at which edge emphasis is conspicuous

B: the level at which edge emphasis is somewhat conspicuous

C: the level at which there is no edge emphasis

TABLE 1

| d:S-Dgap [$\times10^{-6}$ m] | 2V:Vpp [V] | V/d [$\times10^6$ V/m] | Dmax [O.D.] | edge emphasis level | leak level |
|---|---|---|---|---|---|
| 300 | 1000 | 1.67 | 1.39 | B | |
| 300 | 2000 | 3.33 | 1.46 | C | |
| 300 | 3000 | 5.00 | — | — | ○ |
| 300 | 4000 | 6.67 | — | — | ○ |
| 400 | 1000 | 1.25 | 1.36 | A | |
| 400 | 2000 | 2.50 | 1.43 | C | |
| 400 | 3000 | 3.75 | 1.48 | C | |
| 400 | 4000 | 5.00 | — | — | ○ |
| 500 | 1000 | 1.00 | 1.32 | A | |
| 500 | 2000 | 2.00 | 1.40 | C | |
| 500 | 3000 | 3.00 | 1.42 | C | |
| 500 | 4000 | 4.00 | — | — | ○ |
| 600 | 1000 | 0.83 | 1.20 | A | |
| 600 | 2000 | 1.67 | 1.38 | A | |
| 600 | 3000 | 2.50 | 1.42 | B | |
| 600 | 4000 | 3.33 | 1.45 | B | |
| 700 | 1000 | 0.71 | 1.15 | A | |
| 700 | 2000 | 1.43 | 1.37 | A | |
| 700 | 3000 | 2.14 | 1.42 | B | |
| 700 | 4000 | 2.86 | 1.43 | B | |

According to Table 1, when the value V/d was less than 2, low image density (the value of Dmax is less than 1.40) and edge emphasis (the levels A and B) occurred, and when the value of V/d was 4 or greater, leak occurred. Also, edge emphasis (A and B) occurred when S-Dgap was a value greater than 600 $\mu$m. Also, in the conditions of the study of Table 1, when the relation between S-Dgap : d(m) and the amplitude V(V) of the AC bias applied to the developer carrying member is $$2.0\times10^6 \leqq V/d < 4.0\times10^6$$

and further, S-Dgap : d(m) is $6\times10^{-4}$ or less, the fluctuation of the value of Dmax (O.D.) is within 0.06.

As described above, the two-component developer containing a nonmagnetic toner and a magnetic carrier having magnetization of 30 to 200 (emu/cm$^3$) [equal to or greater than 30 and equal to or less than 200] in a magnetic field of 1000 gauss and of which the specific resistance is $10^{12}$ Ωcm or greater in the electric field density of $5\times10^4$ V/m is carried on the surface of the developing sleeve and conveyed to the developing portion. In a magnetic brush developing method of developing the electrostatic latent image on the photosensitive drum disposed in face-to-face relationship with the developing sleeve in the developing portion wherein a developing magnetic field is formed by the developing magnetic poles of the magnet disposed in the developing sleeve, by a developing apparatus using the above-described developer with the developer moved in the direction opposite to the direction of movement of the photosensitive drum and brought into contact with the photosensitive drum, the relation between the gap d(m) between the developing sleeve and the photosensitive drum and the amplitude V(V) of the AC bias applied to the developing sleeve is $$2.0\times10^6 \leqq V/d < 4.0\times10^6$$

and further, the gap d(m) between the developing sleeve and the photosensitive drum is $6\times10^{-4}$ or less, whereby the low image density in the high density portion and edge emphasis can be suppressed.

Further, even when during the production of products, the gap S-Dgap between the developing sleeve and the photosensitive drum fluctuates for each product or even when the gap S-Dgap of the same product differs in the lengthwise direction (the axial direction of the photosensitive drum or the developing sleeve), it becomes possible to provide stable and uniform density.

Embodiment 2

In Embodiment 1, any residual toner on the photosensitive member after the toner image has been transferred onto the transfer material is removed by the cleaning means. In this method, the creation of waste toner is unavoidable, but the waste toner has a bad influence on the environment and the cumbersomeness of maintenance, and the absence thereof is more preferable.

So, as a method which does not put out any waste toner, there is cleaning simultaneous with development. Briefly describing this method, it is a method of collecting any untransferred toner into a developing container by a fog removing electric field at the developing step in the reverse developing process of developing a toner in an exposure portion. The collected toner is again mixed with a carrier and used for image formation and therefore, does not provide any waste toner and cleaning means and waste toner containing means becomes unnecessary and thus, the downsizing and simplification of the apparatus become possible. However, to collect any residual toner at the developing step completely and prevent it from affecting image formation, it becomes necessary that the parting property of the toner with respect to the photosensitive member be high.

A polymeric spherical toner is very high in its parting property with respect to the photosensitive member and is best suited as a toner used in the cleaning process simultaneous with development and further, the present invention can be applied to such an image forming apparatus without any problem.

In the cleaning system simultaneous with development, as described above, during development, any fog toner is collected by a fog removing electric field and an amplitude component of the Vpp of a developing bias which is in a direction to draw the fog toner from the photosensitive drum back to the developing sleeve side (a component in the direction opposite to the development promoting direction). Accordingly, collection efficiency will be further improved if a greater Vpp can be applied as the developing bias by the use of a carrier (developer) of high resistance.

Also, in recent years, an image forming apparatus having four image forming portions (four photo-sensitive drums) corresponding to respective colors and transferring independently formed toner images in succession onto a transfer material has been proposed as a full color printer. The greatest advantage of this apparatus is that a higher speed is possible. On the other hand, a problem peculiar to this apparatus is that the apparatus becomes bulky, but it is apparent that the aforedescribed cleaning process simultaneous with development is very effective for the downsizing of an apparatus having a plurality of image forming portions. The present invention can also be applied to such an image forming apparatus without any problem.

According to the present embodiment, in the above-described cleanerless image forming apparatus as well, a two-component developer containing a nonmagnetic toner and a magnetic carrier having magnetization of 30 to 200 (emu/cm$^3$) [equal to or greater than 30 and equal to or less than 200] in a magnetic field of 1000 gauss and of which the specific resistance is $10^{12}$ Ωcm or greater at electric field intensity of $5\times10^4$ V/m is carried on the surface of a developing sleeve and conveyed to a developing portion. In a magnetic brush developing method of developing an electrostatic latent image on a photosensitive drum disposed in face-to-face relationship with the developing sleeve in the developing portion wherein a developing magnetic field is formed by the developing magnetic poles of a magnet disposed in the developing sleeve, by a developing apparatus using the above-described developer with the developer moved in the direction opposite to the direction of movement of the photosensitive drum and brought into contact with the photosensitive drum, the relation between the gap d(m) between the developing sleeve and the photosensitive drum and the amplitude V(V) of an AC bias applied to the developing sleeve is $$2.0\times10^6 \leqq V/d < 4.0\times10^6$$

and further, the gap d(m) between the developing sleeve and the photosensitive drum is $6\times10^{-4}$ or less, whereby low image density in the high density portion and edge emphasis can be suppressed.

Further, even when during the production of products, the gap S-Dgap between the developing sleeve and the photosensitive drum fluctuates for each product or even when the S-Dgap of the same product differs in the lengthwise direction (the axial direction of the photosensitive drum or the developing sleeve), it becomes possible to provide stable and uniform density. Peculiar irregularity occurring when use is made of a developer comprising a polymeric spherical toner and a magnetic carrier can be prevented and a uniform image can be obtained.

While the embodiments of the present invention have been described above, the present invention is not restricted to these embodiments, but all modifications thereof are possible within the technical idea of the invention.

What is claimed is:

1. A developing apparatus, comprising:

a developer bearing member disposed in an opposed relationship with an image bearing member bearing an electrostatic image thereon with a gap of $6\times10^{-4}$ m or less with respect to said image bearing member, and bearing and conveying a developer thereon, wherein said developer bearing member is moved in a direction opposing a direction of movement of said image bearing member in a portion opposed to said image bearing member, and the developer has a nonmagnetic toner and a carrier of which the magnetization rate in a magnetic field of 1000 gauss is equal to or greater than 30 emu/cm$^3$ and equal to or less than 200 emu/cm$^3$ and the specific resistance at electric field intensity of $5\times10^4$ V/m is $10^{12}$ Ωcm or greater; and applying means for applying a bias voltage having a vibration component to said developer bearing member, wherein the bias voltage applied to said developer bearing member and the gap between said image bearing member and said developer bearing member satisfy the following relation:

$$2.0\times10^6 \leqq V/d < 4.0\times10^6,$$

where

V is the amplitude (V) of the vibration component of the bias voltage;

d is the size (m) of the gap between the image bearing member and the developer bearing member.

2. A developing apparatus according to claim 1, wherein the developer contacts with said developer bearing member.

3. A developing apparatus according to claim 1, wherein the carrier has a core having a magnetic material dispersed in binding resin, and a resin coating layer provided on the core.

4. A developing apparatus according to claim 1, wherein said image bearing member has a photosensitive layer, and the electrostatic image is a dot image formed by exposure by a laser beam.

5. An image forming apparatus comprising:

a developer bearing member disposed in opposed relationship with an image bearing member bearing an electrostatic image thereon with a gap of $6\times10^{-4}$ m or less with respect to said image bearing member, and bearing and conveying a developer thereon, wherein said developer bearing member is moved in a direction opposing a direction of movement of said image bearing member in a portion opposed to said image bearing member, and the developer has a nonmagnetic toner and a carrier of which the magnetization rate in a magnetic field of 1000 gauss is equal to or greater than 30 emu/cm$^3$ and equal to or less than 200 emu/cm$^3$ and the specific resistance at electric field intensity of $5\times10^4$ V/m is $10^{12}$ Ωcm or greater;

applying means for applying a bias voltage having a vibration component to said developer bearing member, wherein the bias voltage applied to said developer bearing member and the gap between the image bearing member and said developer bearing member satisfy the following relation:

$$2.0\times10^6 \leqq v/d < 4.0\times10^6,$$

where

V is the amplitude (V) of the vibration component of the bias voltage;

d is the size (m) of the gap between the image bearing member and the developer bearing member;

a charger for executing charging without effecting removal of a residual toner after image transfer; and means for collecting the residual toner.

* * * * *

UNITED STATES PATENT AND TRADEMARK OFFICE

CERTIFICATE OF CORRECTION

PATENT NO. : 6,049,687

DATED : April 11, 2000

INVENTOR(S) : MASARU HIBINO, ET AL.

It is certified that error appears in the above-identified patent and that said Letters Patent is hereby corrected as shown below:

COLUMN 1:

Line 40, "is" should read --is a--.

COLUMN 10:

Line 27, Insert: (after Table 1)

--*edge emphasis level...

A: the level at which edge emphasis is conspicuous

B: the level at which edge emphasis is somewhat conspicuous

C: the level at which there is no edge emphasis

Line 27, Insert

*leak level...

O: the level at which leak occurred--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*